US009310039B2

(12) United States Patent
Townsend, Jr.

(10) Patent No.: US 9,310,039 B2
(45) Date of Patent: Apr. 12, 2016

(54) TRAFFIC SIGNAL DISCONNECT HOUSING

(71) Applicant: Robert E. Townsend, Jr., West Palm Beach, FL (US)

(72) Inventor: Robert E. Townsend, Jr., West Palm Beach, FL (US)

( * ) Notice: Subject to any disclaimer, the term of this patent is extended or adjusted under 35 U.S.C. 154(b) by 427 days.

(21) Appl. No.: 13/649,812

(22) Filed: Oct. 11, 2012

(65) Prior Publication Data

US 2013/0087672 A1 Apr. 11, 2013

Related U.S. Application Data

(60) Provisional application No. 61/627,385, filed on Oct. 11, 2011.

(51) Int. Cl.

| | |
|---|---|
| ***A47H 1/10*** | (2006.01) |
| ***F21S 8/06*** | (2006.01) |
| ***F21V 21/008*** | (2006.01) |
| ***G08G 1/095*** | (2006.01) |
| ***G08G 1/097*** | (2006.01) |
| ***F21V 19/00*** | (2006.01) |
| ***F21V 23/00*** | (2015.01) |
| *F21W 111/02* | (2006.01) |

(52) U.S. Cl.

CPC ..... *F21S 8/068* (2013.01); *F21V 19/008* (2013.01); *F21V 21/008* (2013.01); *F21V 23/001* (2013.01); *G08G 1/095* (2013.01); *G08G 1/097* (2013.01); *F21W 2111/02* (2013.01)

(58) Field of Classification Search

CPC ..... G08G 1/095; G08G 1/097; G08G 1/00; F21V 21/008; F21V 19/008; F21S 8/068; F21W 2111/02

USPC ..... 248/218.4, 317; 340/907; 362/217.1, 362/217.11, 217.14, 217.15

See application file for complete search history.

(56) References Cited

U.S. PATENT DOCUMENTS

| | | | | | |
|---|---|---|---|---|---|
| 2,925,458 | A * | 2/1960 | Lester | G08G 1/095 | 174/61 |
| 3,424,509 | A * | 1/1969 | Siklos | G08G 1/095 | 174/50 |
| 3,706,070 | A * | 12/1972 | Eikenberry | 362/307 | |
| 4,117,456 | A * | 9/1978 | Albrecht | G09F 13/0413 | 362/196 |
| 4,558,299 | A * | 12/1985 | Conn | G08G 1/095 | 340/907 |
| 5,010,336 | A * | 4/1991 | Mosele | G08G 1/095 | 340/333 |
| 5,517,395 | A * | 5/1996 | Weissman | F21V 31/005 | 116/63 R |
| 6,439,743 | B1 * | 8/2002 | Hutchison | F21V 23/00 | 362/236 |
| 7,307,546 | B1 * | 12/2007 | Partap | G08G 1/095 | 340/815.45 |
| 8,018,350 | B2 * | 9/2011 | Townsend, Jr. | F21V 21/008 | 174/41 |
| 8,540,392 | B2 * | 9/2013 | Townsend, Jr. | G08G 1/095 | 340/907 |
| 8,659,445 | B2 * | 2/2014 | Townsend, Jr. | F21V 21/008 | 174/41 |
| 8,749,402 | B2 * | 6/2014 | Townsend, Jr. | F21V 21/008 | 174/41 |
| 2008/0150757 | A1 * | 6/2008 | Hutchison | G08G 1/095 | 340/907 |

* cited by examiner

*Primary Examiner* — Todd M Epps
(74) *Attorney, Agent, or Firm* — Brinks Gilson & Lione

(57) ABSTRACT

The subject invention pertains to traffic signal disconnect housings having curvatural, arcuate-shaped surfaces that better bear and distribute gravitational and wind induced loading throughout the disconnect housing. In addition, structural reinforcements are provided, as well as support components such as removable, elongated hubs; removable doors; and hook-type hinges.

14 Claims, 4 Drawing Sheets

TRAFFIC SIGNAL DISCONNECT HOUSING

CROSS-REFERENCE TO RELATED APPLICATION

This application claims the benefit of U.S. provisional application Ser. No. 61/627,385, filed Oct. 11, 2011, which is herein incorporated by reference in its entirety.

FIELD OF THE INVENTION

This invention generally relates to the improvement of traffic signal disconnect housing. The basic construction, specifically the structural and mechanical functions have not been significantly changed or improved upon in the last 50 years.

The typical box shape and deficient structural aspects of the disconnect housing are still used throughout the United States despite its known history of structural failures during hurricanes, sometimes resulting in injury and even fatalities due to uncontrolled roadway intersections. Additionally, the prior art's attempt to overcome an operational deficiency resulted in compounding the structural deficiency that led to almost predictable and often disastrous consequences.

BACKGROUND OF THE INVENTION

Known patents of the prior art did not recognize the need to prevent structural failures during hurricanes and primarily were directed to signal viewing stability and housing electrical connections and removability for storm avoidance, maintenance, and repair. Structural references, if any, were directed to gravitational loads specific to weight only.

For structural stability, as an example, the prior art used small extruded ribs to prevent the collar and the signal from "tipping or rocking" during winds. The initial prior art not having a previous experience with disconnect structural failures, especially in non-hurricane regions, could not anticipate the future failures due to hurricane force winds. The still in use today "rib" portions were primarily designed for signal stability to increase visibility during winds having a velocity that can still be safely driven in.

The purpose and function of the "ribs" can also be found in the later art, where "four diagonal grooves" were added as a means to prevent the movement the earlier art described. All other known prior art does not anticipate movement during wind events, but instead described "upwardly" directed forces on the traffic signal while servicing, and also described the structural requirements specific to supporting the signal's weight, with no mention or description of any type of wind loads. A furtherance as to no prior art anticipation of structural failures due to hurricanes can be found specific where such phrases as: "in hurricane prone areas it is often necessary or desirable to remove the signal lights from the hanger and terminal disconnect housing," "supported connection and which is also adapted to be quickly removed from the hanger and terminal (housing) box during inclement weather." A manufacturer of the prior art's disconnect housing, regarding the disconnect housing, in a letter to Florida's Department of Transportation stated . . . "not designed to withstand hurricane force wind forces . . . ," " . . . never been tested or expected to support hurricane wind forces . . . ," " . . . the breakage was with the disconnects . . . " and " . . . the majority of the damaged disconnects broke at the bottom, where the hub is located . . . ," specific to all "ribbed" and "grooved" portions as described in all known prior art.

As previously stated, the art's patents all have almost identical structural designs that are historically proven to fail due to the inventors not anticipating or understanding structural failures of disconnect housings due to hurricanes.

Both the earlier devices provided limited space inside the housings for electrical components and actual space to perform the electrical work. As the U.S. population increased (from the 1960's) large intersections requiring more electrical components compounded the already limited space provided in the prior art devices.

To overcome this deficiency, later art disclosed a larger, rectangular disconnect housing that had two doors for access and added size for room to perform the electrical connections. Though an improvement for operation, the new design of disconnect housings actually was proven historically to experience extremely high quantities of structural failures during hurricanes.

BRIEF SUMMARY OF THE INVENTION

In view of the foregoing background, it is therefore an object of the present invention to provide a structurally and operationally improved disconnect housing. The present invention comprises integral reinforcements into structurally superior curvatural, arcuate-shaped signal disconnect housings, support components of removable elongated type hubs, and a novel means for attachment and load distribution.

Gravitational and wind induced loads are borne, transferred, and distributed through the disconnect housing by arcuate surfaces. "Curvatural" or "arcuate" include cylindrical, circular, oval, ovoid, and any other surface having curvature to smoothly distribute loading, as opposed to, for example, surface planes meeting at a distinct angle where load stresses are focused and affect a structurally weaker portion of a traditional disconnect housing.

In certain embodiments, the current invention also provides a new linear structural improvement using a novel system that employs the access door's surface area to distribute the loads that occur adjacent to each side of a removable hub's receivement slot. More particularly the novel system utilizes a new hook type hinge along the continuous reinforced top of a housing and a means of securing the previously described hub area with an additional new benefit of fasteners to secure the housing, door, and removable hubs to one another, thereby furthering the structural ability far and well beyond any known prior art.

In sharp contrast to the prior art's teachings, the present invention, in some embodiments, has fewer parts—performing greater functions, recognizes and addresses the prior art's deficiencies, and provides an easier and more efficient means of manufacturing.

DETAILED DISCLOSURE OF THE INVENTION

Figure 1:
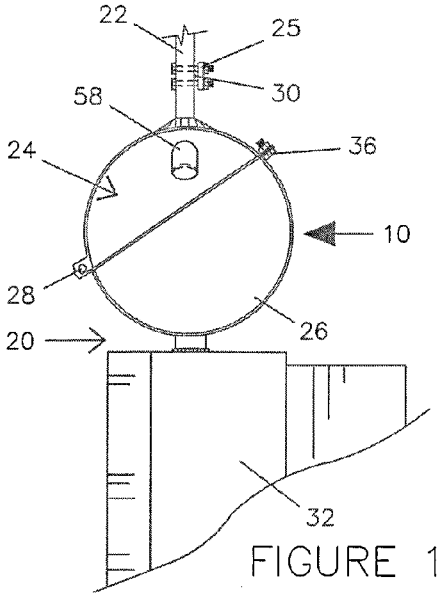
FIG. 1 is a side view of the present invention shown in the closed position.

While this invention is susceptible to embodiment in many different forms, there is shown in the drawings and will herein be described in detail, several specific embodiments with the understanding that the present disclosure is to be considered as an exemplification of the principles of the invention and is not intended to limit the invention to the embodiments so illustrated. Each of the following described embodiments of the present invention provides a vast structural improvement over the previously described prior art by a) eliminating all previous known failure areas by replacing the weak angles and corners with structurally superior, circular or other cylindrical or arcuate designed disconnect housings maximizing the use of curves to more equally distribute loading and associated stresses due to wind gravitational impact forces. The structural improvement also provides an average of 4 to 5 times the amount of the prior art's hold down securement and approximately 70 square inches of distributed surface loading v. the 4-5 square inches that has been utilized in the prior art over the last 50 years without change. The curved design, reinforced construction, and the approximate 93% increased reinforcement of the surface areas of the known failure areas of the prior art will undoubtedly and greatly increase the survivability of traffic signals during high wind events such as hurricanes.

One particular unexpected result from the new design was the increased accessibility to the electrical components inside the improved disconnect housing. Accessibility was one of the key reasons for the initial and still today widespread use of disconnect housings.

Another unexpected improvement over the prior art was discovered in the novel hook type hinged connection at the top of the housing's door, which surprisingly provides a very significant increase in structural stability by the addition of fasteners in areas not contemplated prior to this new invention.

Another increased benefit in some embodiments of the new invention is the ease of manufacturing.

Yet another positive, unexpected result in some embodiments is the new invention's aerodynamic features that resist wind forces by load shedding, a characteristic particularly applicable to the first and second preferred embodiments as described in Examples 1 and 2 below.

The preferred material, but not limited to same, for the new signal disconnect housing is cast aluminum. However, other materials such as extruded type aluminum piping or forged metals, and/or metal injection, may also be preferred and/or meeting governmental regulations, as will be apparent to those skilled in the art. Fasteners are preferably stainless steel as appropriate.

EXAMPLE 1

FIG. 1 is a side view of a cylindrical embodiment of the present invention (10) illustrating the top portion (24) that is secured to the existing hanger assembly (22) which allows for the attachment of the bottom portion (26) utilizing the continuous removable hook type hinge (28). Final securement of the top (24) and bottom (26) is by way of attachment flanges (54) more fully depicted in FIGS. 2 and 3. Also shown for reference is an existing traffic control assembly (20) comprising of, but not limited to, a traffic signal (32) and sometimes a dual or, alternatively, a single span wire hanger assembly (22) and disconnect housing (10). Though able to accept common dual span (upper and lower) wire hangers such as a "tether cable," rigid flat aluminum, and even pipe hangers, the preferred hanger is the pivotal assembly shown and described in U.S. Pat. No. 8,018,350 (incorporated herein by reference in its entirety). The preferred signal reinforcement (not shown) is also described in the '350 patent reference.

Figure 2:
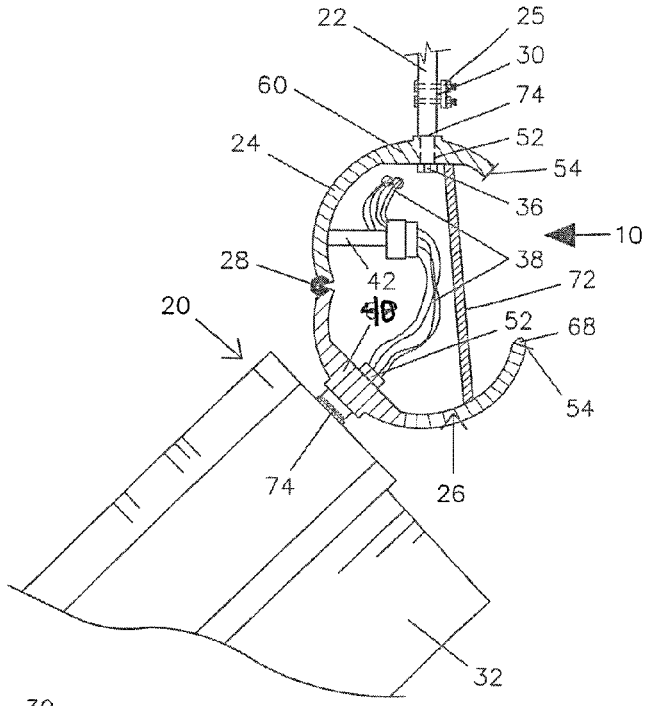
FIG. 2 is also a side through-sectional view of the present invention shown in the open position.
Figure 3:
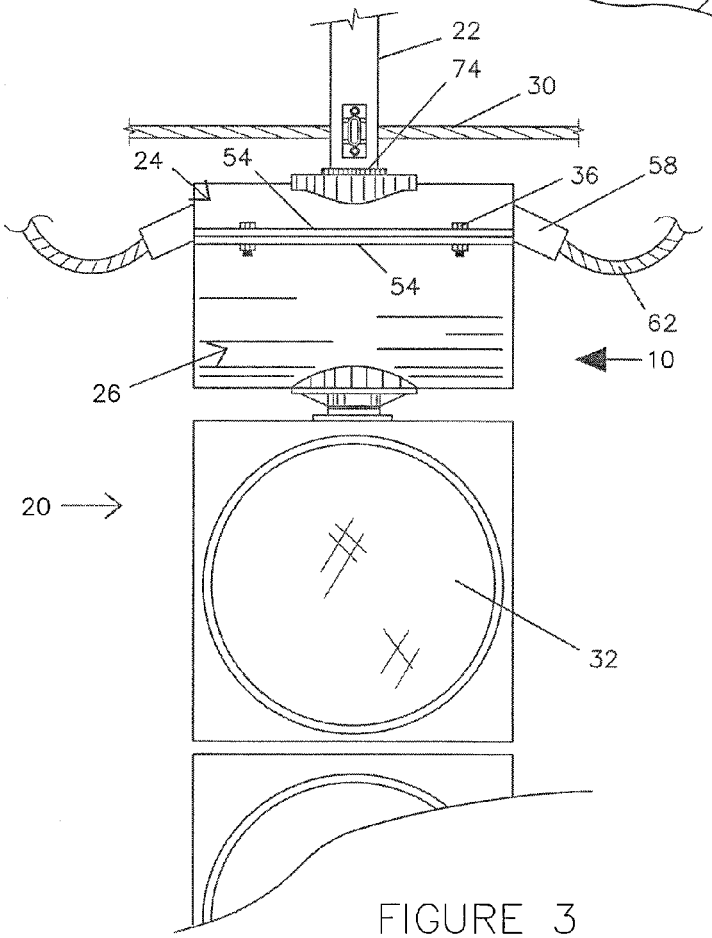
FIG. 3 is a front view of the present invention.

FIG. 2 is an illustration showing a side view of the disconnect housing (10) in the open position revealing the operational aspect of the device, and FIG. 3 is a closed, front view of the disconnect housing. Top (24) as previously mentioned is secured to the existing span wire (30) by utilizing the hanger assembly (22) that is secured to the top's (24) integral reinforcement (60) using any suitable fasteners (36) through aperture (52). Upon completion of hanging the top (24) the electrical work can begin by inserting the main conductors (62) through the grommetted access apertures (58) and securing the electrical wiring (38) to terminal block (40) as required. Terminal block (40) is fastened to the mounting bosses (42). Continuing to the bottom (26), this bottom portion provides two primary functions; i.e. a reinforced signal attachment hub and the bottom closure of the present invention. The integral reinforcement hub (48) attaches to the traffic signal by any suitable means and/or requirement. As an example, a typical tri-stud with nuts and washer may be acceptable. The aperture (52) is designed to accommodate both the wiring and additional suitable fastening if desired. A single fastener such as an elongated bolt with additional reinforcements may also be added as another embodiment of the present invention. In some cases a positioning stay (72) (shown in phantom) may be necessary to increase access and temporarily lock movement of the top and bottom relative to each other.

After the bottom (26) and the traffic signal (32) are secured to one another, the signal's electrical can be extended through the aperture (52) making the now connected devices ready to attach to the top portion (24). The bottom portion and attached signal is positioned beneath the top portion so that a second portion of the continuous removable hook type hinge (28) can be dropped into a first portion of hinge (28) allowing the bottom portion (26) to rotate for access and final closing of the disconnect housing (10). The first portion of hinge (28) is integral to the top (24) and the second portion of hinge (28) is integral to the bottom (26). After connecting the bottom (26) to the top (24) the final electrical (38) can be completed. To complete the installation of traffic control assembly (20), the bottom portion (26) is brought forward so that both top (24) and bottom (26) attachment flanges (54) meet together and are secured by fasteners (36) as appropriate, over gasket (68). Referring now to FIG. 3, depicting a front elevational view of the present invention (10), the top (24) is shown connected to the bottom (26) by the means of attaching each portion (top—bottom) of attachment flanges (54) together using appropriate fasteners (36). Serrations are (74) typical to all top/bottom hubs for incremental positioning of the traffic signal assembly.

EXAMPLE 2

Figure 4:
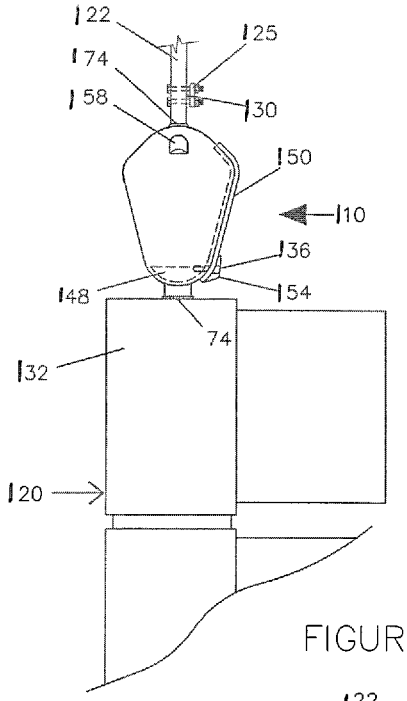
FIG. 4 is a side view of another embodiment of the present invention.

With reference now to FIGS. 4-7 a second preferred embodiment is depicted, of which FIG. 4 is a side view of another, arcuate embodiment of the present invention. This second embodiment's base construction is a structurally reinforced disconnect housing (110) and utilizes an improved-elongated reinforced, removable hub (148), along with removable door (150) that in some cases may be hinged, preferably a structural continuous type as more fully depicted in FIG. 6. Though able to accept common dual span (upper and lower) wire hangers such as a "tether cable," rigid flat aluminum, and even pipe hangers, the preferred hanger is the pivotal assembly shown and described in U.S. Pat. No. 8,018,350. The preferred signal reinforcement (not shown) is also described in the '350 patent reference.

Figure 5:
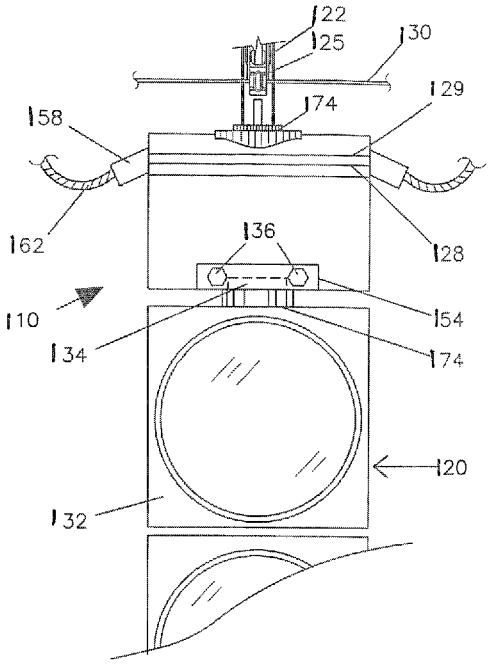
FIG. 5 is a frontal view of the second preferred embodiment of the present invention.

With reference to FIG. 5, a frontal elevational view showing the disconnect housing (110), span wire (130), hanger assembly (122) and traffic signal (132) comprising a traffic control assembly (120). Door (150) is shown with installation access slot (134) shown in phantom.

Figure 6:
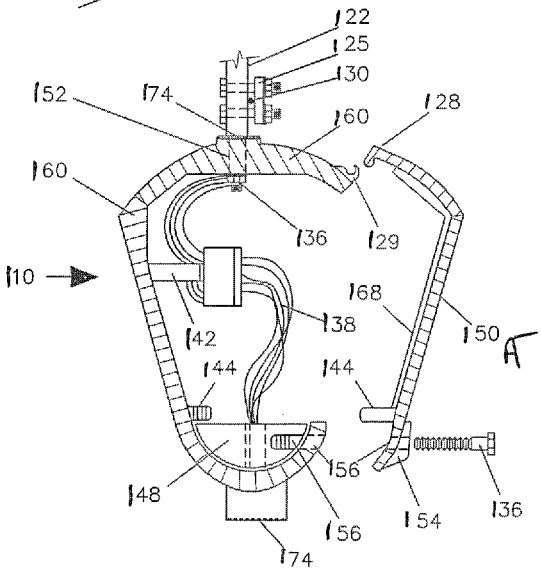
FIG. 6 is a through-sectional view of the present invention.

FIG. 6's through-sectional view illustrates the present invention (110) showing integral reinforcements (160), removable hub (148), and removable door (150). The disconnect housing (110) is supported by the hanger (122) operationally secured to the housing (110) integral reinforcement (160) secured with any suitable fasteners (136). Reinforced hub (148) is secured to the traffic signal head as previously described and then lifted and rotationally placed into the housing (110) through slot (134) making sure that the back edge of elongated reinforced hub (148) rolls under full length hold down boss (144). After completion of the electrical work (138, 140), door (150) with hold down boss (144) is installed by placing continuous hook insert hinge (128) into continuous receiving hook hinge (129) and then securing using fasteners (136) through door (150), housing (110), then into the removable hub (148) threaded insert (156) over gaskets (168). This mechanical connection as described provides an additional linear support system by transferring down load of the bottom through the door (150) to the structurally superior, uninterrupted top portion.

Figure 7:
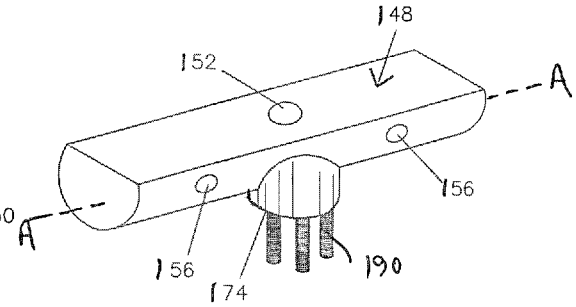
FIG. 7 is an isometric view of the elongated reinforced removable attachment hub.

FIG. 7 illustrates the reinforced removable hub (148) as previously described, also showing the aperture (152) able to accept wire access and additional or alternate securements if desired. Hub may also be angular in shape in lieu of rounded provided housing's receivement is of a shape that is mating to hub (148). Signal attachment points (190) are shown extending downward, perpendicular to the hub's elongated dimension (A-A) in this embodiment, which is a preferred, but not essential, characteristic.

EXAMPLE 3

Figure 8:
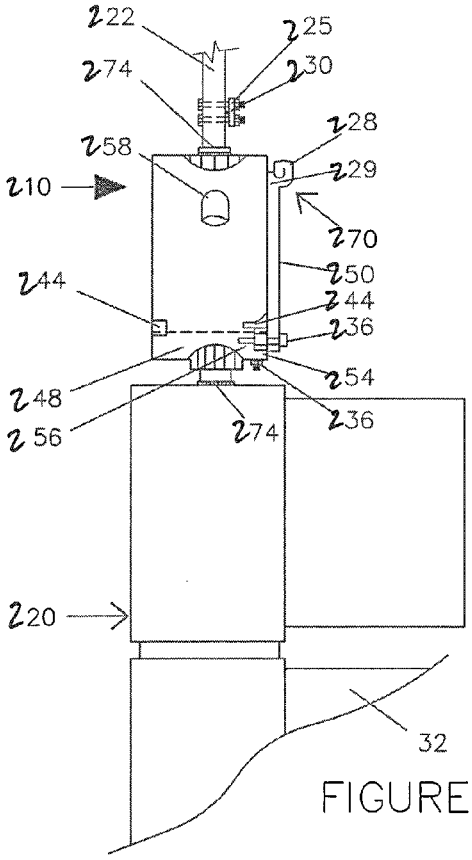
FIG. 8 is yet another embodiment of the present invention's side view.
Figure 9:
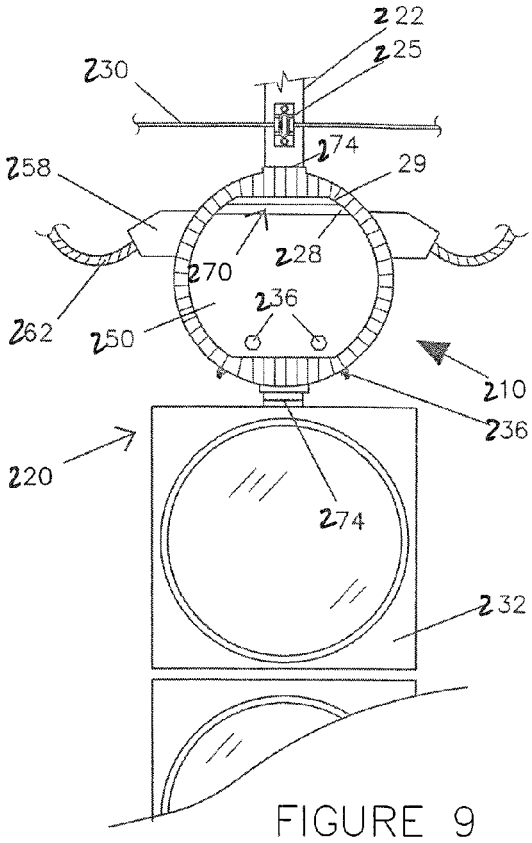
FIG. 9 is a frontal view of the third preferred embodiment of the present invention.
Figure 10:
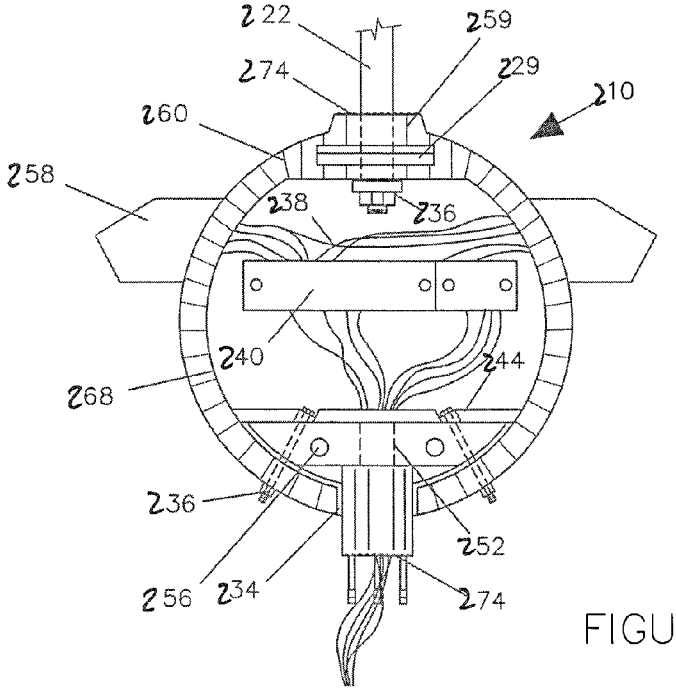
FIG. 10 shows an interior view of the third preferred embodiment of the present invention.

FIG. 8-10 reveal yet another, circular embodiment of the present invention, with FIG. 8 depicting a side elevation of a traffic control assembly (220) comprising a hanger assembly (222), span wire (230), present invention housing (210) and traffic signal (232). Continuous hold down bosses (244) integral to the housing (210) and door (250) are shown in phantom. Door (250) is secured to the housing (210) by hook type flange (270) over gasketing (268). Door (250) is secured by through bolting as previously described in FIG. 6. Though able to accept common dual span (upper and lower) wire hangers such as a "tether cable," rigid flat aluminum, and even pipe hangers, the preferred hanger is the pivotal assembly shown and described in U.S. Pat. No. 8,018,350. The preferred signal reinforcement (not shown) is also described in the '350 patent reference.

FIG. 9 is a frontal elevation of the present invention (210) showing the grommetted wire access (258), and removable door (250) that in some cases may be hinged (as, for example, is depicted with the removable door (150) in the embodiment of FIG. 6).

FIG. 10 is also a front elevation, but showing an interior view of the present invention (210). Weatherproof access for conductor is provided by grommetted apertures (258) door gasket (268) also weather proofing the disconnect housing (210). Installation of hanger (222) through reinforcement (260) is secured as previously described. Also shown is the reinforced hub (248) installed as previously described using access slot (234) and full length boss (244). To complete the installation, install door (250) as previously described. The embodiment shown may also be elongated into an oval for better access, if desired, to a limit of structural stability in the new oval design. Aperture (252) is provided for wires and/or fasteners to install retrofitted reinforcements to the signal (232) below. This mechanical connection as described provides an additional linear support system by transferring down load of the bottom through the door (250) to the structurally superior, uninterrupted top portion.

EXAMPLE 4

Figure 11:
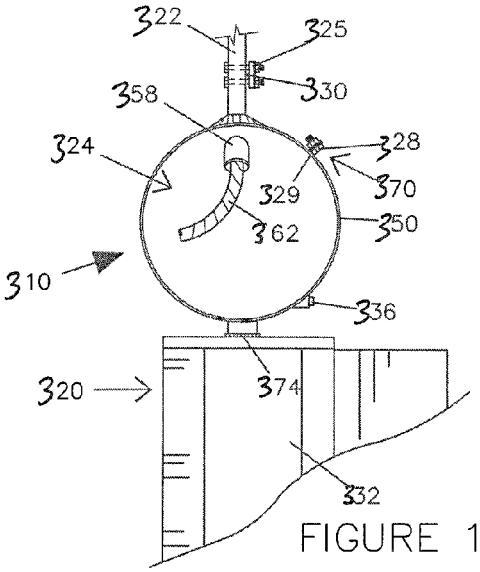
FIG. 11 is a side view of yet another embodiment.

FIG. 11 is a side elevation showing a cylindrical embodiment of the present invention in the closed position. Hanger (322) is connected to the existing span wire (330) using tether clamp (325). Weatherproof access for the main conductors (362) is provided through grommetted access (358).

Figure 12:
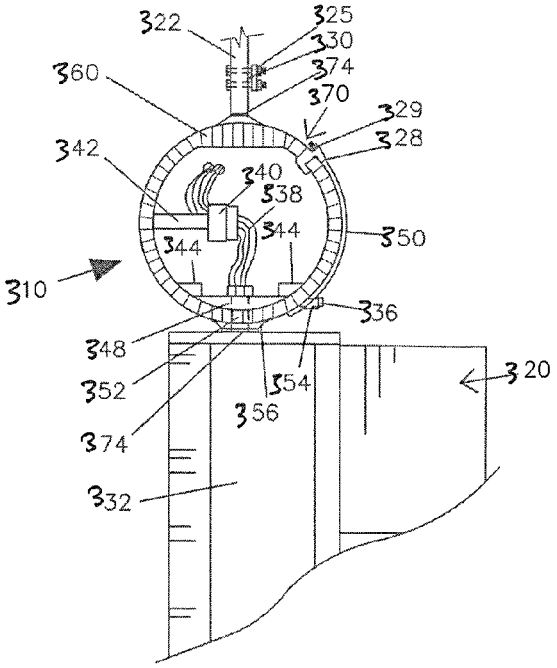
FIG. 12 depicts a side through-section.

Turning now to FIG. 12 which depicts a through section of a cylindrical embodiment of the present invention (310) below previously described hanger system. Also shown is the hook type flange system (370) to be more fully described in FIG. 14. The removable hub (348) is held in place at the back portion of the housing (310) with continuous hold down boss (344) similar in function and size to the door's (350) hold down boss (344). Integral reinforcement (360) is shown below serrated hub (374). The removable hub (348) is further secured by fasteners (336) through door's (350) attachment boss (354) through housing (310) and into hub's threaded inserts (356) with final tightening compressing gasketing (368) to complete a weather proof installation. Wire access to the signal is provided by aperture (352), additional access is also provided for fasteners to install retrofitted reinforcement if also desired to signal (332) below.

Figure 13:
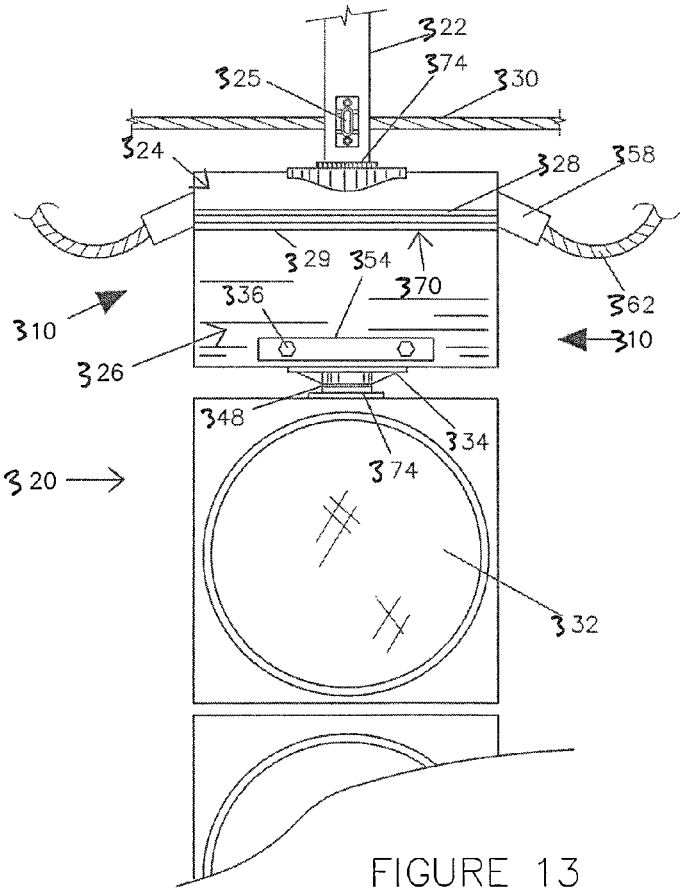
FIG. 13 illustrates a front view of another embodiment.

FIG. 13 is a frontal elevation of the present invention (310) showing the continuous top hook type flange (370) above bottom attachment boss/flange (354) secured by fasteners (336) as previously described. Though able to accept common dual span (upper and lower) wire hangers such as a "tether cable," rigid flat aluminum, and even pipe hangers, the preferred hanger is the pivotal assembly shown and described in U.S. Pat. No. 8,018,350. The preferred signal reinforcement (not shown) is also described in the '350 patent reference. This mechanical connection as described provides an additional linear support system by transferring down load of the bottom through the door (350) to the structurally superior, uninterrupted top portion.

Figure 14:
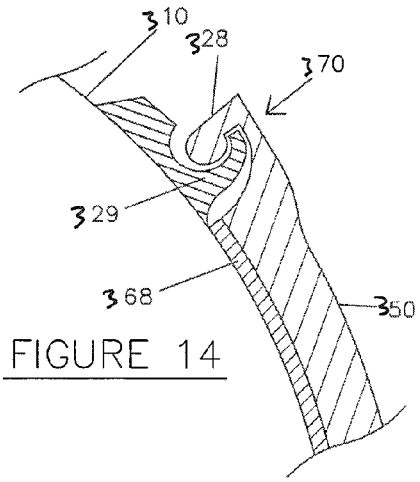
FIG. 14 is a sectional view of the hook type hinge of the present invention

FIG. 14 depicts a cross-sectional view of the housing (310) and structural load spreading door (350) pivotally connected at the upper portion by continuous hook type flange (370) comprising a continuous hook type receiving portion (329) integral to housing (310) and continuous hook type insert portion (328) that is integral to door (350) secured as previously described over gasketing (368).

All patents, patent applications, provisional applications, and publications referred to or cited herein are incorporated by reference in their entirety, including all figures and tables, to the extent they are not inconsistent with the explicit teachings of this specification.

Following are examples that illustrate procedures for practicing the invention. These examples should not be construed as limiting. All percentages are by weight and all solvent mixture proportions are by volume unless otherwise noted.

It should be understood that the examples and embodiments described herein are for illustrative purposes only and that various modifications or changes in light thereof will be suggested to persons skilled in the art and are to be included within the spirit and purview of this application and the scope of the appended claims. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

I claim:

1. A traffic signal disconnect housing comprising an arcuate top portion and an arcuate bottom portion, said arcuate top portion configured for attachment to a hanger assembly and said arcuate bottom portion configured for attachment to a traffic signal, at least a portion of said arcuate top portion extending from a hanger assembly connection point to a hinged connection on a body of the traffic signal disconnect housing, wherein the hinged connection comprises a continuous removable hook type hinge and whereby gravitational and wind induced loads are distributed through said arcuate top and bottom portions.

2. A traffic signal disconnect housing according to claim 1, further comprising a door connected to the top arcuate portion at the hinged connection.

3. A traffic signal disconnect housing comprising an arcuate top portion and an arcuate bottom portion, said arcuate top portion configured for attachment to a hanger assembly and said arcuate bottom portion configured for attachment to a traffic signal, at least a portion of said arcuate top portion extending from a hanger assembly connection point to a hinged connection on a body of the traffic signal disconnect housing; a removable hub comprising a signal attachment point and having an elongated dimension, the removable hub configured to complementarily rest against an internal surface of said arcuate bottom portion, wherein said bottom portion comprises a hub receivement slot configured such that when said removable hub is placed into said bottom portion the hub's signal attachment point extends down through the hub receivement slot; whereby when a traffic signal is attached to the signal attachment point, the gravitational load of the traffic signal is distributed through the removable hub along its elongated dimension and to the complementarily shaped arcuate bottom portion, and whereby gravitational and wind induced loads are distributed through said arcuate top and bottom portions.

4. A traffic signal disconnect housing according to claim 3, wherein said housing is a circular, oval, or ovoid housing.

5. A traffic signal disconnect housing according to claim 3, wherein the elongated dimension is perpendicular to the signal attachment point.

6. A traffic signal disconnect housing according to claim 3, further comprising a removable door configured such that when secured to the arcuate top and bottom portions, the door serves to distribute loads between the arcuate top and bottom portions.

7. A traffic signal disconnect housing according to claim 6, wherein said arcuate top portion comprises a continuous receiving portion and said door comprises a continuous insert portion, the continuous receiving and insert portions comprising the hinged connection and being complementarily configured to engage each other.

8. A traffic signal disconnect housing according to claim 7, wherein said door is secured to said arcuate bottom portion by at least one fastener extending through said door and into said arcuate bottom portion.

9. A traffic signal disconnect housing according to claim 8, wherein said door has an inner surface and an outer surface, the inner surface comprising an integral hold down boss configured such that when said door is secured to said arcuate bottom portion, the hold down boss is above a top surface of the removable hub and thereby helps to hold the removable hub in place.

10. A traffic signal disconnect housing according to claim 3, wherein the hinged connection comprises a hook-type hinge.

11. A traffic signal disconnect housing comprising:

an arcuate top portion and an arcuate bottom portion, said arcuate top portion configured for attachment to a hanger assembly and said arcuate bottom portion configured for attachment to a traffic signal, whereby gravitational and wind induced loads are distributed through said arcuate top and bottom portions;

a removable door configured such that when secured to the arcuate top and bottom portions, the door serves to distribute loads between the arcuate top and bottom portions, an upper portion of the removable door being secured to the arcuate top portion with a hinged connection; and a fastener, wherein said fastener extends through said door, though a portion of said arcuate bottom portion, and into a removable hub.

12. A traffic signal disconnect housing according to claim 11, wherein said arcuate top portion comprises a continuous receiving portion and said door comprises a continuous insert portion, the continuous receiving and insert portions comprising the hinged connection and being complementarily configured to engage each other.

13. A traffic signal disconnect housing according to claim 12, wherein said door is secured to said arcuate bottom portion by at least one fastener extending through said door and into said arcuate bottom portion.

14. A traffic signal disconnect housing according to claim 13, wherein said arcuate bottom portion comprises an integral reinforcement hub and said fastener extends through said door and into the integral reinforcement hub.

* * * * *